US012478186B2

(12) United States Patent
Li et al.

(10) Patent No.: US 12,478,186 B2
(45) Date of Patent: Nov. 25, 2025

(54) CHAIR FRAME AND CHAIR

(71) Applicant: DEWERTOKIN TECHNOLOGY GROUP CO., LTD., Jiaxing (CN)

(72) Inventors: Long Li, Jiaxing (CN); Liming Yang, Jiaxing (CN); Guowei Wang, Jiaxing (CN); Bin Shen, Jiaxing (CN); Kangming Tao, Jiaxing (CN); Qiqi Ye, Jiaxing (CN); Guangjiao Zhang, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 169 days.

(21) Appl. No.: 18/562,143

(22) PCT Filed: Aug. 23, 2021

(86) PCT No.: PCT/CN2021/114117
§ 371 (c)(1),
(2) Date: Nov. 17, 2023

(87) PCT Pub. No.: WO2022/241965
PCT Pub. Date: Nov. 24, 2022

(65) Prior Publication Data

US 2024/0215726 A1 Jul. 4, 2024

(30) Foreign Application Priority Data

May 18, 2021 (CN) ..... 202121058656.0

(51) Int. Cl.
*A47C 1/034* (2006.01)

(52) U.S. Cl.
CPC ..... *A47C 1/0345* (2013.01)

(58) Field of Classification Search
CPC ..... A47C 1/0345
See application file for complete search history.

(56) References Cited

U.S. PATENT DOCUMENTS 5,360,255 A * 11/1994 Cook ..... D6/335
5,772,278 A * 6/1998 Kowalski ..... A47C 1/0355 297/85 L (Continued)

FOREIGN PATENT DOCUMENTS

CN 109602205 A 4/2019
CN 110731643 A 1/2020

(Continued)

OTHER PUBLICATIONS

International Search Report for corresponding application PCT/CN2021/114117 filed on Aug. 23, 2021; Mail date Feb. 21, 2022.

*Primary Examiner* — Anthony D Barfield
(74) *Attorney, Agent, or Firm* — CANTOR COLBURN LLP

(57) ABSTRACT

Provided are a chair frame and a chair. The chair frame supports a human waist and back by using a waist support assembly and supports human legs and feet by using a footstool assembly. Meanwhile, when the waist support assembly is unfolded, driven by a second support rod, a second end of a first support rod can swing toward the footstool assembly with a junction between a first end of the first support rod and the second support rod as a rotation center to increase an included angle between a waist support bracket and a seat cushion bracket, that is, increasing an unfolded angle of a backrest and achieving the zero gravity effect. The chair can improve the chair comfort by applying the preceding chair frame.

20 Claims, 3 Drawing Sheets

(56) References Cited

U.S. PATENT DOCUMENTS

| | | | | | |
|---|---|---|---|---|---|
| 5,823,614 | A * | 10/1998 | Johnson | A47C 1/0355 | |
| | | | | 297/452.4 | |
| 10,299,597 | B1 * | 5/2019 | Crum | A47C 1/0355 | |
| 10,709,246 | B2 * | 7/2020 | Murphy | A47C 1/0345 | |

FOREIGN PATENT DOCUMENTS

| | | | |
|---|---|---|---|
| CN | 111265048 | A | 6/2020 |
| CN | 111602993 | A | 9/2020 |
| CN | 111642922 | A | 9/2020 |
| CN | 111972901 | A | 11/2020 |
| KR | 102244747 | B1 | 4/2021 |

* cited by examiner

CHAIR FRAME AND CHAIR

CROSS-REFERENCE TO RELATED APPLICATION

This is a National stage application, filed under 37 U.S.C. 371, of International Patent Application NO. PCT/CN2021/114117, filed on Aug. 23, 2021, which is based on and claims priority to Chinese Patent Application No. 202121058656.0 filed on May 18, 2021, the disclosure of which is incorporated herein by reference in its entirety.

TECHNICAL FIELD

The present disclosure relates to the technical field of furniture, for example, a chair frame and a chair.

BACKGROUND

A zero gravity chair, designed by combining the zero gravity principle with chair technologies, utilizes the ergonomic design of the chair and zero gravity technologies to make the horizontal line of an occupant's lower legs higher than the position of the occupant's heart so as to place the occupant in a natural state. This can resist the discomfort brought by the gravity of the earth, simultaneously place the center of gravity of the occupant's body on the occupant's hip fat and make other body parts free from pressure so as to relax the body.

However, at present, backrest opening angles of zero gravity chairs on the market are not large enough, and the comfort is low.

SUMMARY

The present disclosure provides a chair frame that can increase an unfolded angle of a backrest, achieve the zero gravity effect and have higher comfort.

The present disclosure further provides a chair. The chair comfort can be improved by applying the preceding chair frame.

In an aspect, a chair frame is provided. The chair frame includes a seat cushion bracket, and a transmission assembly, a waist support assembly and a footstool assembly that are disposed on the seat cushion bracket.

The waist support assembly is pivotally connected to a first end of the transmission assembly and includes a waist support bracket and a waist support rod group, the waist support rod group includes a first support rod, a second support rod and a third support rod, a first end of the third support rod is pivotally connected to the seat cushion bracket, a second end of the third support rod is pivotally connected to the waist support bracket, a first end of the second support rod is connected to the transmission assembly, a second end of the second support rod is pivotally connected to a third end of the third support rod, a first end of the first support rod is pivotally connected to a third end of the second support rod, and a second end of the first support rod is pivotally connected to the waist support bracket.

The waist support assembly is configured such that when the waist support assembly is unfolded, driven by the second support rod, the second end of the first support rod is able to swing toward the footstool assembly with a junction between the first end of the first support rod and the second support rod as a rotation center.

The footstool assembly is pivotally connected to a second end of the transmission assembly, is further connected to an external driving apparatus and is configured to, driven by the external driving apparatus, be able to fold or unfold and drive the transmission assembly and the waist support assembly to fold or unfold.

In another aspect, a chair is provided and includes the preceding chair frame.

REFERENCE LIST

Figure 1:
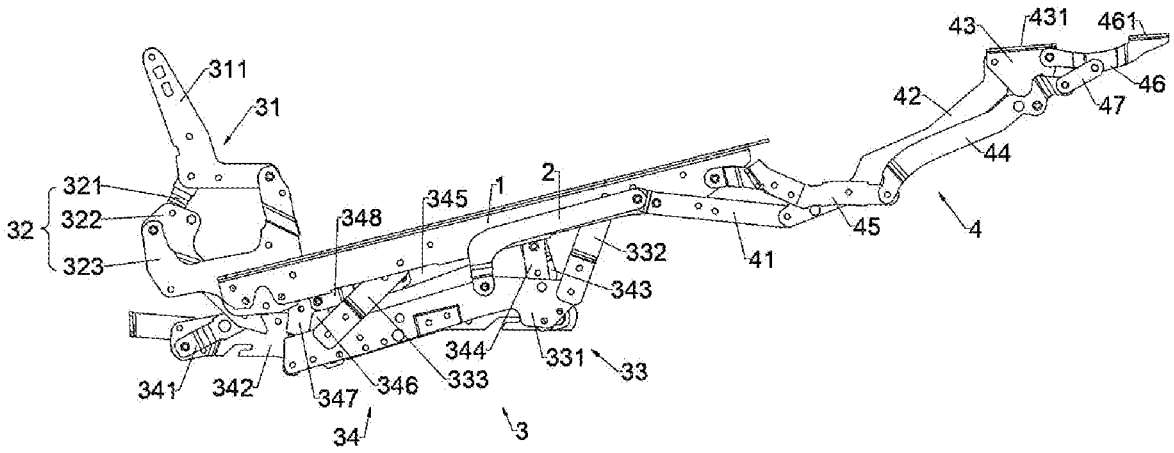
FIG. 1 is a view illustrating the structure when a chair frame is unfolded according to embodiments of the present disclosure.

1 seat cushion bracket
2 transmission assembly
3 waist support assembly
31 waist support bracket
311 waist support segment
32 waist support rod group
321 first support rod
322 second support rod
323 third support rod
33 waist support transmission rod group
331 first transmission rod
332 second transmission rod
333 third transmission rod
34 waist support connecting rod group
341 first connecting rod
342 second connecting rod
343 third connecting rod
344 fourth connecting rod
345 fifth connecting rod
346 sixth connecting rod
347 seventh connecting rod
348 eighth connecting rod
349 ninth connecting rod
4 footstool assembly
41 first foot rod
42 second foot rod
43 third foot rod
431 middle footstool attachment platform
44 fourth foot rod
45 fifth foot rod
46 footstool bracket

461 footstool attachment platform
47 sixth foot rod

DETAILED DESCRIPTION

It is to be noted that similar reference numerals and letters indicate similar items in subsequent drawings. Therefore, once some item is defined in one drawing, the item needs no more definition and explanation in the subsequent drawings.

In the description of the present disclosure, it is to be noted that the orientational or positional relationships indicated by terms such as "above", "below", "left", "right", "vertical", "horizontal", "inside", "outside" and the like are based on the orientational or positional relationships illustrated in the drawings or the orientational or positional relationship that products of the present disclosure are usually used in, which are for the mere purpose of facilitating and simplifying the description of the present disclosure and do not indicate or imply that the apparatus or element referred to has a specific orientation and is constructed and operated in a specific orientation, and thus it is not to be construed as limiting the present disclosure. Moreover, terms such as "first", "second" and "third" are merely for distinguishing the descriptions and are not to be construed as indicating or implying relative importance. In the description of the present disclosure, unless otherwise noted, the term "a plurality of" or "multiple" refers to two or more.

In the description of the present disclosure, it is also to be noted that unless otherwise expressly specified and limited, the term "configured" or "connected" is to be construed in a broad sense, for example, as securely connected, detachably connected or internally connected; or mechanically connected or electrically connected. For those of ordinary skill in the art, specific meanings of the preceding terms in the present disclosure may be understood based on specific situations.

In the present disclosure, unless otherwise expressly specified and limited, when a first feature is described as "on" or "under" a second feature, the first feature and the second feature may be in direct contact or may be in indirect contact via another feature between the two features instead of being in direct contact. Moreover, when the first feature is described as "on". "above", or "over" the second feature, the first feature is right on, above, or over the second feature, the first feature is obliquely on, above, or over the second feature, or the first feature is simply at a higher level than the second feature. When the first feature is described as "under". "below", or "underneath" the second feature, the first feature is right under, below, or underneath the second feature, the first feature is obliquely under, below, or underneath the second feature, or the first feature is simply at a lower level than the second feature.

Embodiments of the present disclosure are described in detail below. Examples of the embodiments are illustrated in the drawings, where the same or similar reference numerals indicate the same or similar elements or elements having the same or similar functions. The embodiments described below with reference to the drawings are illustrative, only for explaining the present disclosure, and not to be construed as limiting the present disclosure.

Figure 2:
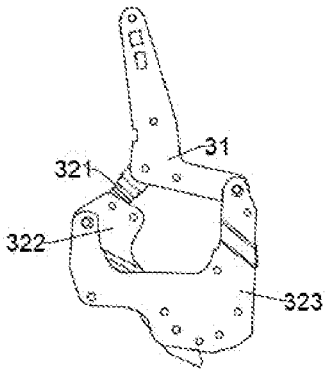
FIG. 2 is a view illustrating the structure of a waist support rod group according to embodiments of the present disclosure.

As shown in FIGS. 1 to 6, this embodiment provides a chair frame. The chair frame includes a seat cushion bracket 1, and a transmission assembly 2, a waist support assembly 3 and a footstool assembly 4 that are disposed on the seat cushion bracket 1. The waist support assembly 3 is pivotally connected to a first end of the transmission assembly 2. The footstool assembly 4 is pivotally connected to a second end of the transmission assembly 2 and is further connected to an external driving apparatus so as to enable the footstool assembly 4, driven by the external driving apparatus, to be able to fold or unfold and drive the transmission assembly 2 and the waist support assembly 3 to fold or unfold. The waist support assembly 3 includes a waist support bracket 31 and a waist support rod group 32. As shown in FIG. 2 and in conjunction with FIG. 1, the waist support rod group 32 includes a first support rod 321, a second support rod 322 and a third support rod 323. A first end of the third support rod 323 is pivotally connected to the seat cushion bracket 1, and a second end of the third support rod 323 is pivotally connected to the waist support bracket 31. A first end of the second support rod 322 is connected to the transmission assembly 2, and a second end of the second support rod 322 is pivotally connected to a third end of the third support rod 323. A first end of the first support rod 321 is pivotally connected to a third end of the second support rod 322, and a second end of the first support rod 321 is pivotally connected to the waist support bracket 31. When the waist support assembly 3 is unfolded, driven by the second support rod 322, the second end of the first support rod 321 can swing toward the footstool assembly 4 with a junction between the first end of the first support rod 321 and the second support rod 322 as a rotation center.

Optionally, an included angle between an upper end surface of the seat cushion bracket 1 and the horizontal plane ranges from 16° to 28°.

Optionally, the waist support bracket 31 includes a waist support segment 311 for supporting a waist, and an included angle between the waist support segment 311 and the upper end surface of the seat cushion bracket 1 ranges from 135° to 150° so that an unfolded angle of the waist support bracket 31 can be increased.

A human waist and back are supported by using the waist support assembly 3, and human legs and feet are supported by using the footstool assembly 4. Meanwhile, when the waist support assembly 3 is unfolded, driven by the second support rod 322, the second end of the first support rod 321 can swing toward the footstool assembly 4 with the junction between the first end of the first support rod 321 and the second support rod 322 as the rotation center to increase the included angle between the waist support bracket 31 and the seat cushion bracket 1, that is, increasing an unfolded angle of a backrest and achieving the zero gravity effect.

Optionally, the waist support assembly 3 further includes a waist support transmission rod group 33 and a waist support connecting rod group 34 that are each pivotally connected to the seat cushion bracket 1, the waist support transmission rod group 33 is pivotally connected between the transmission assembly 2 and the waist support connecting rod group 34, and the waist support connecting rod group 34 is pivotally connected between the waist support transmission rod group 33 and the waist support rod group 32.

Optionally, the transmission assembly 2 is an adapter transmission rod. Two ends of the adapter transmission rod 2 are pivotally connected to the waist support transmission rod group 33 and the footstool assembly 4 respectively. The external driving apparatus directly drives the footstool assembly 4 to act, then transmits a driving force through the adapter transmission rod 2 and drives the waist support transmission rod group 33 to drive the linkage of the waist support connecting rod group 34 and the waist support rod group 32.

Figure 4:
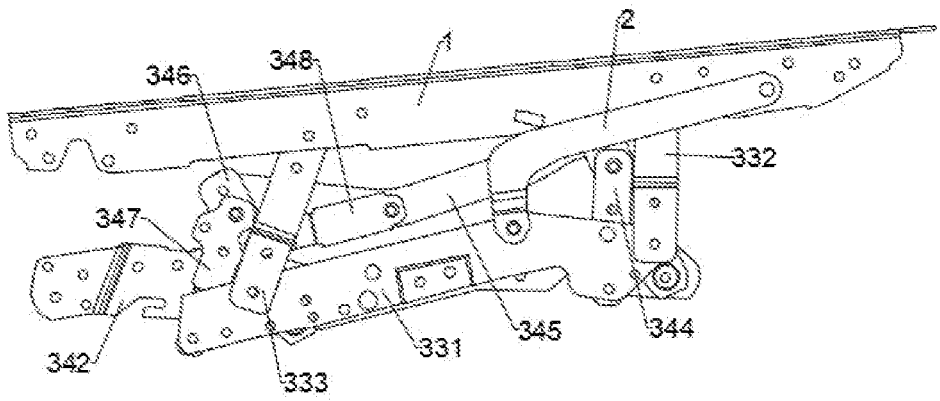
FIG. 4 is a view illustrating a connection relationship between a waist support connecting rod group and a seat cushion bracket taken from a viewing angle according to embodiments of the present disclosure.

Optionally, referring to FIGS. 1 and 4, the waist support transmission rod group 33 includes a first transmission rod 331, a second transmission rod 332 and a third transmission rod 333. The first transmission rod 331 is pivotally connected to a first end of the adapter transmission rod 2.

A first end of the second transmission rod 332 is pivotally connected to a first end of the first transmission rod 331, and a second end of the second transmission rod 332 is pivotally connected to the seat cushion bracket 1. A first end of the third transmission rod 333 is pivotally connected to a second end of the first transmission rod 331, and a second end of the third transmission rod 333 is pivotally connected to the seat cushion bracket 1.

Figure 3:
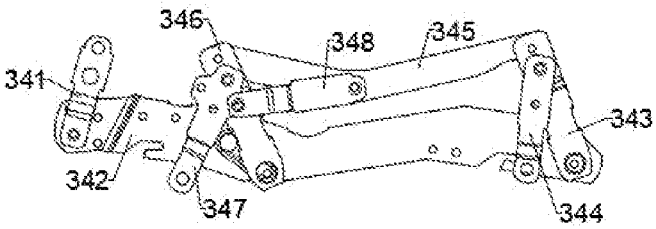
FIG. 3 is a view illustrating the structure of a waist support connecting rod group according to embodiments of the present disclosure.
Figure 5:
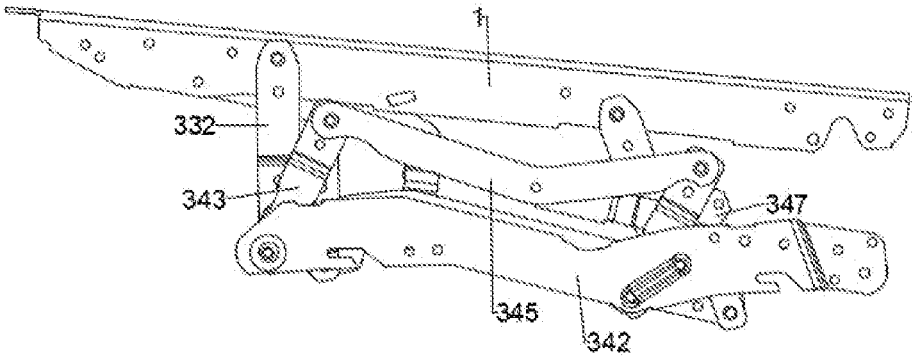
FIG. 5 is a view illustrating a connection relationship between a waist support connecting rod group and a seat cushion bracket taken from another viewing angle according to embodiments of the present disclosure.
Figure 6:
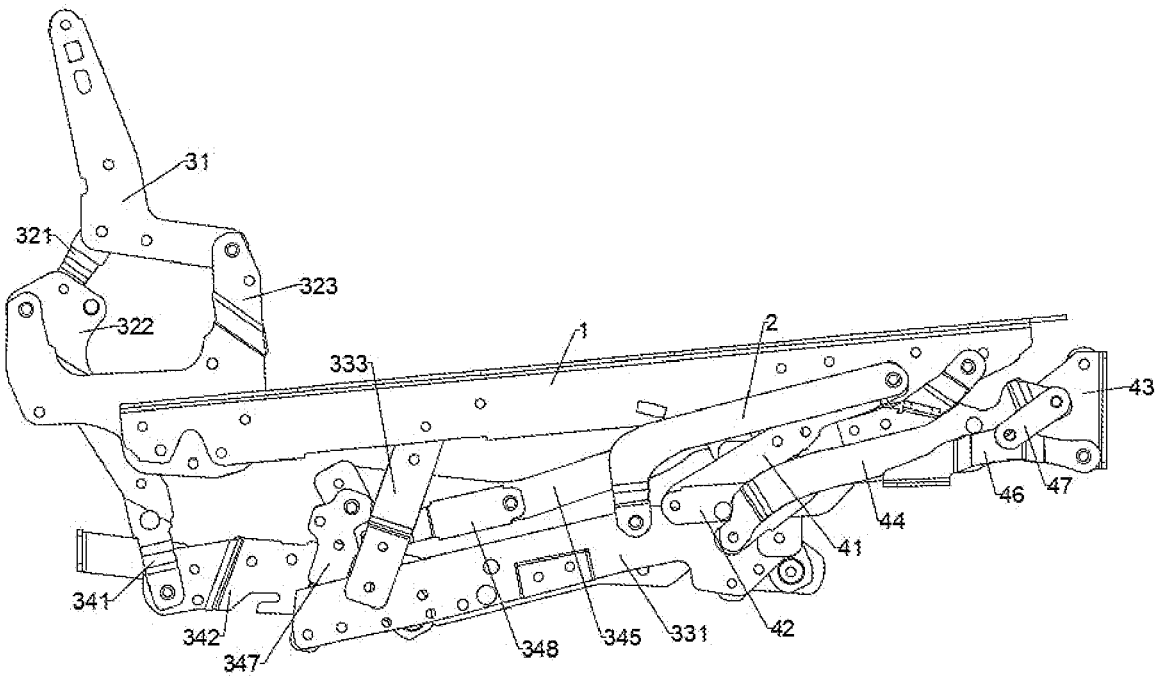
FIG. 6 is a view illustrating the structure when a chair frame is folded according to embodiments of the present disclosure.

Optionally, as shown in FIGS. 3 to 5 and in conjunction with FIG. 1, the waist support connecting rod group 34 includes a first connecting rod 341, a second connecting rod 342, a third connecting rod 343, a fourth connecting rod 344, a fifth connecting rod 345, a sixth connecting rod 346, a seventh connecting rod 347 and an eight connecting rod 348. A first end of the first connecting rod 341 is pivotally connected to the second support rod 322. A first end of the second connecting rod 342 is pivotally connected to a second end of the first connecting rod 341. A first end of the third connecting rod 343 is pivotally connected to a second end of the second connecting rod 342. A first end of the fourth connecting rod 344 is pivotally connected to the middle of the third connecting rod 343, and a second end of the fourth connecting rod 344 is pivotally connected to the first transmission rod 331. A first end of the fifth connecting rod 345 is pivotally connected to a second end of the third connecting rod 343. A first end of the sixth connecting rod 346 is pivotally connected to a second end of the fifth connecting rod 345, and a second end of the sixth connecting rod 346 is pivotally connected to the middle of the second connecting rod 342. A first end of the seventh connecting rod 347 is pivotally connected to the first transmission rod 331, and a second end of the seventh connecting rod 347 is pivotally connected to the middle of the sixth connecting rod 346. A first end of the eighth connecting rod 348 is pivotally connected to the middle of the seventh connecting rod 347, and a second end of the eighth connecting rod 348 is pivotally connected to the middle of the fifth connecting rod 345. The seventh connecting rod 347 is a cross-shaped structure. The eighth connecting rod 348 is connected to a third end of the cross-shaped structure of the seventh connecting rod 347.

Optionally, the footstool assembly 4 includes a first foot rod 41, a second foot rod 42, a third foot rod 43, a fourth foot rod 44, a fifth foot rod 45, a footstool bracket 6 and a sixth foot rod 47. A first end of the first foot rod 41 is pivotally connected to the seat cushion bracket 1 and a second end of the adapter transmission rod 2. A first end of the second foot rod 42 is pivotally connected to a second end of the first foot rod 41. A first end of the third foot rod 43 is pivotally connected to a second end of the second foot rod 42. A first end of the fourth foot rod 44 is pivotally connected to a second end of the third foot rod 43. A first end of the fifth foot rod 45 is pivotally connected to a second end of the fourth foot rod 44, and a second end of the fifth foot end 45 is pivotally connected to the seat cushion bracket 1, and the fifth foot rod 45 is securely connected to the external driving apparatus through an adapter. A first end of the footstool bracket 46 is pivotally connected to the third foot rod 43, and a second end of the footstool bracket 46 is provided with a footstool attachment platform 461 configured to attach a footstool. A first end of the sixth foot rod 47 is pivotally connected to the fourth foot rod 44, and a second end of the sixth foot rod 47 is pivotally connected to the footstool bracket 46.

Optionally, a middle footstool attachment platform 431 is disposed on the third foot rod 43 and is configured to attach a middle footstool.

Figure 7:
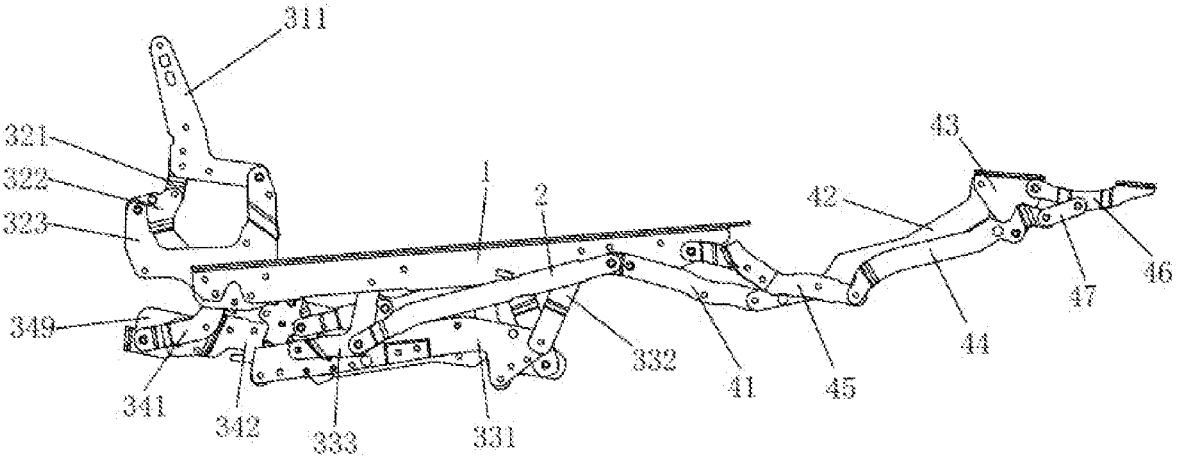
FIG. 7 is a view illustrating the structure when a chair frame is unfolded according to an embodiment.

In an embodiment, as shown in FIG. 7, the adapter transmission rod 2 may also be strip-shaped, and the shape of the third transmission rod 333 is curved. In this case, the first end of the third transmission rod 333 is pivotally connected to the second end of the first transmission rod 331, the second end of the third transmission rod 333 is pivotally connected to the seat cushion bracket 1, and a third end of the third transmission rod 333 is pivotally connected to the first end of the adapter transmission rod 2. Moreover, the waist support connecting rod group 34 further includes a ninth connecting rod 349. A first end of the ninth connecting rod 349 is pivotally connected to the second end of the first connecting rod 341, and a second end of the ninth connecting rod 349 is pivotally connected to the first end of the second connecting rod 342, that is, the first connecting rod 341 and the second connecting rod 342 are pivotally connected through the ninth connecting rod 349. The rest of the structures and their connection relationships remain the same, and reference may be made to FIGS. 1 to 6 and the preceding related description.

This embodiment further provides a chair including the preceding chair frame. The chair comfort can be improved by applying the preceding chair frame.

What is claimed is:

1. A chair frame, comprising a seat cushion bracket, and a transmission assembly, a waist support assembly and a footstool assembly that are disposed on the seat cushion bracket;

wherein the waist support assembly is pivotally connected to a first end of the transmission assembly and comprises a waist support bracket and a waist support rod group, the waist support rod group comprises a first support rod, a second support rod and a third support rod, a first end of the third support rod is pivotally connected to the seat cushion bracket, a second end of the third support rod is pivotally connected to the waist support bracket, a first end of the second support rod is connected to the transmission assembly, a second end of the second support rod is pivotally connected to a third end of the third support rod, a first end of the first support rod is pivotally connected to a third end of the second support rod, and a second end of the first support rod is pivotally connected to the waist support bracket;

the waist support assembly is configured such that when the waist support assembly is unfolded, driven by the second support rod, the second end of the first support rod is able to swing toward the footstool assembly with a junction between the first end of the first support rod and the second support rod as a rotation center; and the footstool assembly is pivotally connected to a second end of the transmission assembly, is further connected to an external driving apparatus and is configured to, driven by the external driving apparatus, be able to fold or unfold and drive the transmission assembly and the waist support assembly to fold or unfold;

wherein the waist support assembly further comprises a waist support transmission rod group and a waist support connecting rod group that are each pivotally connected to the seat cushion bracket, the waist support transmission rod group is pivotally connected between the transmission assembly and the waist support connecting rod group, and the waist support connecting rod group is pivotally connected between the waist support transmission rod group and the waist support rod group;

wherein the transmission assembly is an adapter transmission rod, and two ends of the adapter transmission rod are pivotally connected to the waist support transmission rod group and the footstool assembly respectively:

wherein the waist support transmission rod group comprises: a first transmission rod pivotally connected to a first end of the adapter transmission rod; a second transmission rod, wherein a first end of the second transmission rod is pivotally connected to a first end of the first transmission rod, and a second end of the second transmission rod is pivotally connected to the seat cushion bracket; and a third transmission rod, wherein a first end of the third transmission rod is pivotally connected to a second end of the first transmission rod, and a second end of the third transmission rod is pivotally connected to the seat cushion bracket.

2. The chair frame according to claim 1, wherein the waist support connecting rod group comprises:

a first connecting rod, wherein a first end of the first connecting rod is pivotally connected to the second support rod;

a second connecting rod, wherein a first end of the second connecting rod is pivotally connected to a second end of the first connecting rod;

a third connecting rod, wherein a first end of the third connecting rod is pivotally connected to a second end of the second connecting rod;

a fourth connecting rod, wherein a first end of the fourth connecting rod is pivotally connected to the third connecting rod, and a second end of the fourth connecting rod is pivotally connected to the first transmission rod;

a fifth connecting rod, wherein a first end of the fifth connecting rod is pivotally connected to a second end of the third connecting rod;

a sixth connecting rod, wherein a first end of the sixth connecting rod is pivotally connected to a second end of the fifth connecting rod, and a second end of the sixth connecting rod is pivotally connected to the second connecting rod;

a seventh connecting rod, wherein a first end of the seventh connecting rod is pivotally connected to the first transmission rod, and a second end of the seventh connecting rod is pivotally connected to the sixth connecting rod; and an eighth connecting rod, wherein a first end of the eighth connecting rod is pivotally connected to the seventh connecting rod, and a second end of the eighth connecting rod is pivotally connected to the fifth connecting rod.

3. The chair frame according to claim 2, wherein the waist support bracket comprises a waist support segment for supporting a waist, and an included angle between the waist support segment and an upper end surface of the seat cushion bracket ranges from 135° to 150°.

4. The chair frame according to claim 1, wherein the footstool assembly comprises:

a first foot rod, wherein a first end of the first foot rod is pivotally connected to the seat cushion bracket and a second end of the adapter transmission rod separately;

a second foot rod, wherein a first end of the second foot rod is pivotally connected to a second end of the first foot rod;

a third foot rod, wherein a first end of the third foot rod is pivotally connected to a second end of the second foot rod;

a fourth foot rod, wherein a first end of the fourth foot rod is pivotally connected to a second end of the third foot rod;

a fifth foot rod, wherein a first end of the fifth foot rod is pivotally connected to a second end of the fourth foot rod, a second end of the fifth foot rod is pivotally connected to the seat cushion bracket, and the fifth foot rod is securely connected to the external driving apparatus through an adapter;

a footstool bracket, wherein a first end of the footstool bracket is pivotally connected to the third foot rod, and a second end of the footstool bracket is provided with a footstool attachment platform; and a sixth foot rod, wherein a first end of the sixth foot rod is pivotally connected to the fourth foot rod, and a second end of the sixth foot rod is pivotally connected to the footstool bracket.

5. The chair frame according to claim 4, wherein a middle footstool attachment platform is disposed on the third foot rod.

6. The chair frame according to claim 5, wherein the waist support bracket comprises a waist support segment for supporting a waist, and an included angle between the waist support segment and an upper end surface of the seat cushion bracket ranges from 135° to 150°.

7. The chair frame according to claim 4, wherein the waist support bracket comprises a waist support segment for supporting a waist, and an included angle between the waist support segment and an upper end surface of the seat cushion bracket ranges from 135° to 150°.

8. The chair frame according to claim 1, wherein an included angle between an upper end surface of the seat cushion bracket and a horizontal plane ranges from 16° to 28°.

9. The chair frame according to claim 1, wherein the waist support bracket comprises a waist support segment for supporting a waist, and an included angle between the waist support segment and an upper end surface of the seat cushion bracket ranges from 135° to 150°.

10. A chair, comprising the chair frame according to claim 1.

11. A chair frame, comprising a seat cushion bracket, and a transmission assembly, a waist support assembly and a footstool assembly that are disposed on the seat cushion bracket;

wherein the waist support assembly is pivotally connected to a first end of the transmission assembly and comprises a waist support bracket and a waist support rod group, the waist support rod group comprises a first support rod, a second support rod and a third support rod, a first end of the third support rod is pivotally connected to the seat cushion bracket, a second end of the third support rod is pivotally connected to the waist support bracket, a first end of the second support rod is connected to the transmission assembly, a second end of the second support rod is pivotally connected to a third end of the third support rod, a first end of the first support rod is pivotally connected to a third end of the second support rod, and a second end of the first support rod is pivotally connected to the waist support bracket;

the waist support assembly is configured such that when the waist support assembly is unfolded, driven by the second support rod, the second end of the first support rod is able to swing toward the footstool assembly with a junction between the first end of the first support rod and the second support rod as a rotation center; and the footstool assembly is pivotally connected to a second end of the transmission assembly, is further connected to an external driving apparatus and is configured to, driven by the external driving apparatus, be able to fold or unfold and drive the transmission assembly and the waist support assembly to fold or unfold;

wherein the waist support assembly further comprises a waist support transmission rod group and a waist support connecting rod group that are each pivotally connected to the seat cushion bracket, the waist support transmission rod group is pivotally connected between the transmission assembly and the waist support connecting rod group, and the waist support connecting rod group is pivotally connected between the waist support transmission rod group and the waist support rod group;

wherein the transmission assembly is an adapter transmission rod, and two ends of the adapter transmission rod are pivotally connected to the waist support transmission rod group and the footstool assembly respectively;

wherein the waist support transmission rod group comprises:

a first transmission rod;

a second transmission rod, wherein a first end of the second transmission rod is pivotally connected to a first end of the first transmission rod, and a second end of the second transmission rod is pivotally connected to the seat cushion bracket; and a third transmission rod, wherein a first end of the third transmission rod is pivotally connected to a second end of the first transmission rod, a second end of the third transmission rod is pivotally connected to the seat cushion bracket, and a third end of the third transmission rod is pivotally connected to a first end of the adapter transmission rod.

12. The chair frame according to claim 11, wherein the waist support bracket comprises a waist support segment for supporting a waist, and an included angle between the waist support segment and an upper end surface of the seat cushion bracket ranges from 135° to 150°.

13. A chair, comprising the chair frame according to claim 11.

14. The chair frame according to claim 11, wherein the waist support connecting rod group comprises:

a first connecting rod, wherein a first end of the first connecting rod is pivotally connected to the second support rod;

a second connecting rod;

a third connecting rod, wherein a first end of the third connecting rod is pivotally connected to a second end of the second connecting rod;

a fourth connecting rod, wherein a first end of the fourth connecting rod is pivotally connected to the third connecting rod, and a second end of the fourth connecting rod is pivotally connected to the first transmission rod;

a fifth connecting rod, wherein a first end of the fifth connecting rod is pivotally connected to a second end of the third connecting rod;

a sixth connecting rod, wherein a first end of the sixth connecting rod is pivotally connected to a second end of the fifth connecting rod, and a second end of the sixth connecting rod is pivotally connected to the second connecting rod;

a seventh connecting rod, wherein a first end of the seventh connecting rod is pivotally connected to the first transmission rod, and a second end of the seventh connecting rod is pivotally connected to the sixth connecting rod; an eighth connecting rod, wherein a first end of the eighth connecting rod is pivotally connected to the seventh connecting rod, and a second end of the eighth connecting rod is pivotally connected to the fifth connecting rod; and a ninth connecting rod, wherein a first end of the ninth connecting rod is pivotally connected to a second end of the first connecting rod, and a second end of the ninth connecting rod is pivotally connected to a first end of the second connecting rod.

15. The chair frame according to claim 14, wherein the waist support bracket comprises a waist support segment for supporting a waist, and an included angle between the waist support segment and an upper end surface of the seat cushion bracket ranges from 135° to 150°.

16. A chair frame, comprising a seat cushion bracket, and a transmission assembly, a waist support assembly and a footstool assembly that are disposed on the seat cushion bracket;

wherein the waist support assembly is pivotally connected to a first end of the transmission assembly and comprises a waist support bracket and a waist support rod group, the waist support rod group comprises a first support rod, a second support rod and a third support rod, a first end of the third support rod is pivotally connected to the seat cushion bracket, a second end of the third support rod is pivotally connected to the waist support bracket, a first end of the second support rod is connected to the transmission assembly, a second end of the second support rod is pivotally connected to a third end of the third support rod, a first end of the first support rod is pivotally connected to a third end of the second support rod, and a second end of the first support rod is pivotally connected to the waist support bracket;

the waist support assembly is configured such that when the waist support assembly is unfolded, driven by the second support rod, the second end of the first support rod is able to swing toward the footstool assembly with a junction between the first end of the first support rod and the second support rod as a rotation center; and the footstool assembly is pivotally connected to a second end of the transmission assembly, is further connected to an external driving apparatus and is configured to, driven by the external driving apparatus, be able to fold or unfold and drive the transmission assembly and the waist support assembly to fold or unfold;

wherein the waist support assembly further comprises a waist support transmission rod group and a waist support connecting rod group that are each pivotally connected to the seat cushion bracket, the waist support transmission rod group is pivotally connected between the transmission assembly and the waist support connecting rod group, and the waist support connecting rod group is pivotally connected between the waist support transmission rod group and the waist support rod group;

wherein the transmission assembly is an adapter transmission rod, and two ends of the adapter transmission rod are pivotally connected to the waist support transmission rod group and the footstool assembly respectively;

wherein the footstool assembly comprises:

a first foot rod, wherein a first end of the first foot rod is pivotally connected to the seat cushion bracket and a second end of the adapter transmission rod separately;

a second foot rod, wherein a first end of the second foot rod is pivotally connected to a second end of the first foot rod;

a third foot rod, wherein a first end of the third foot rod is pivotally connected to a second end of the second foot rod;

a fourth foot rod, wherein a first end of the fourth foot rod is pivotally connected to a second end of the third foot rod;

a fifth foot rod, wherein a first end of the fifth foot rod is pivotally connected to a second end of the fourth foot rod, a second end of the fifth foot rod is pivotally connected to the seat cushion bracket, and the fifth foot rod is securely connected to the external driving apparatus through an adapter;

a footstool bracket, wherein a first end of the footstool bracket is pivotally connected to the third foot rod, and a second end of the footstool bracket is provided with a footstool attachment platform; and a sixth foot rod, wherein a first end of the sixth foot rod is pivotally connected to the fourth foot rod, and a second end of the sixth foot rod is pivotally connected to the footstool bracket.

17. The chair frame according to claim 16, wherein a middle footstool attachment platform is disposed on the third foot rod.

18. The chair frame according to claim 17, wherein the waist support bracket comprises a waist support segment for supporting a waist, and an included angle between the waist support segment and an upper end surface of the seat cushion bracket ranges from 135° to 150°.

19. The chair frame according to claim 16, wherein the waist support bracket comprises a waist support segment for supporting a waist, and an included angle between the waist support segment and an upper end surface of the seat cushion bracket ranges from 135° to 150°.

20. A chair, comprising the chair frame according to claim 16.

* * * * *